US006130699A

United States Patent [19]

Christensen et al.

[11] Patent Number: 6,130,699

[45] Date of Patent: Oct. 10, 2000

[54] THERMAL INK PRINTER WITH MEDIA SUPPLY

[75] Inventors: Christopher Roy Christensen, Clermont; William M. Bouverie, Windemere; Kenneth Colonel, Oviedo; Mark Allen Hitz, Lake Mary, all of Fla.

[73] Assignee: Datamax Corporation, Orlando, Fla.

[21] Appl. No.: 08/887,670

[22] Filed: Jul. 3, 1997

[51] Int. Cl.[7] ..... B41J 33/16

[52] U.S. Cl. ..... 347/218; 400/234; 400/613

[58] Field of Search ..... 347/218, 219; 400/618, 613, 613.1, 234

[56] References Cited

U.S. PATENT DOCUMENTS

| | | | |
|---|---|---|---|
| 4,547,780 | 10/1985 | Cummins | 346/9 |
| 4,642,656 | 2/1987 | Shibuya et al. | 347/215 |
| 4,797,690 | 1/1989 | Takita et al. | 346/105 |
| 5,318,368 | 6/1994 | Fogle et al. | 400/208 |
| 5,326,182 | 7/1994 | Hagstrom | 400/223 |
| 5,340,098 | 8/1994 | Gunderson | 271/21 |
| 5,378,072 | 1/1995 | Gunderson | 400/692 |
| 5,478,159 | 12/1995 | Schneider et al. | 400/232 |
| 5,480,242 | 1/1996 | Gunderson | 400/208 |
| 5,496,121 | 3/1996 | Gunderson | 400/692 |
| 5,717,495 | 2/1998 | Sakai et al. | 358/296 |
| 5,820,279 | 10/1998 | Lodwig et al. | 400/234 |
| 5,938,350 | 8/1999 | Colonel | 400/234 |

FOREIGN PATENT DOCUMENTS

| | | |
|---|---|---|
| 59-156786 | 9/1984 | Japan . |
| 61-197267 | 9/1986 | Japan . |
| 4-292972 | 9/1992 | Japan . |

*Primary Examiner*—N. Le
*Assistant Examiner*—Anh T. N. Vo
*Attorney, Agent, or Firm*—Dilworth & Barrese, LLP

[57] ABSTRACT

A media supply for a thermal ink printer, includes a central shaft defining a longitudinal axis, a media hub for supporting a supply of media in a coiled configuration coaxially mounted about the central shaft and adapted for rotational movement thereabout, a hub clamp mounted to the media hub and adapted for axial movement therealong to accommodate media supplies of various lengths and a torsion spring mounted about the central shaft and operatively engageable with the media hub to rotatably bias the media hub to an initial position corresponding to an unstressed condition of the torsion spring in response to movement of the media hub through a predetermined angular sector of rotation in one rotational direction, to thereby maintain a predetermined level of tension on the media. A locking member may be associated with the hub clamp to selectively secure the hub clamp at a predetermined axial position.

24 Claims, 4 Drawing Sheets

THERMAL INK PRINTER WITH MEDIA SUPPLY

BACKGROUND OF THE INVENTION

1. Field of the Invention

The present invention relates generally to thermal printers and, more particularly, to a media supply for use in thermal ink transfer printers.

2. Description of the Prior Art

The use of electronically controlled thermal printers has increased very rapidly over the last few years. In particular, the market for thermal label printers has shown significant improvement with users focusing on utilizing label printing, especially, bar-code labelling, to improve capital asset management, inventory control or time and attendance reporting—or to meet corporate or industry mandated labelling requirements—such as automotive AIAG, electronic EIA or retail UCC/UPC specifications. Label printers typically incorporate a media supply of "peel away" labels adhered to a coated substrate wound in a rolled configuration. The media with the labels is drawn against a printing head, which, in turn, causes, by localized heating, a transfer of ink from an ink ribbon to a label.

In conventional label printers, the media is positioned or "hung" about a support and is drawn off the media core to be sent through the printing head by a drive motor associated with the printing head or with a take-up roll mechanism. A disadvantage of this prior art arrangement, however, is that the media when passing through the printing head is not under tension, which, undesirably affects registration of the printing head with the media labels. This results in less accuracy or registration of the print, and, consequently a relatively increased number of rejected printed units.

Accordingly, the present invention overcomes the disadvantages of the prior art by providing a media hub supply to be incorporated in a thermal transfer printers, which maintains a defined axis of rotation for the media and a constant drag or tension on the media during the printing process to thereby improve print quality and print registration.

SUMMARY OF THE INVENTION

A media supply for a thermal ink printer, includes a central shaft defining a longitudinal axis, a media hub for supporting a supply of media in a coiled configuration coaxially mounted about the central shaft and adapted for rotational movement thereabout, a hub clamp mounted to the media hub and adapted for axial movement therealong to accommodate media supplies of various lengths, and a torsion spring mounted about the central shaft and operatively engageable with the media hub to rotatably bias the media hub to an initial position corresponding to an unstressed condition of the torsion spring in response to movement of the media hub through a predetermined angular sector of rotation in one rotational direction, to thereby maintain a predetermined level of tension on the media. A locking member may be associated with the hub clamp to selectively secure the hub clamp at a predetermined axial position.

The media hub may include at least one longitudinal rib extending radially from the outer surface of the media hub and being dimensioned to engage the interior surface of the media supply in frictional engagement therewith. Preferably, first and second diametrically opposed longitudinal ribs are provided. The hub clamp may include an inner longitudinal recess dimensioned to accommodate the one longitudinal rib.

A clutch mechanism is associated with the media hub to permit the torsion spring to return to the unstressed condition in response to movement of the media hub beyond the predetermined angular sector of rotation. With this arrangement, a spring support collar is operatively connected to one end portion of the torsion spring wherein the other end portion of the torsion spring is operatively connected to the media hub. The clutch mechanism may further include a compression spring and a clutch plate. The compression spring is in operative engagement with the clutch plate and is dimensioned to bias the clutch plate toward the spring support collar. The clutch plate is in contacting frictional engagement with the spring support collar, wherein movement of the media hub beyond the predetermined angular sector of rotation causes release of the clutch plate from frictional engagement with the spring support collar to permit the spring support collar to move relative to the clutch plate to thereby enable the tension spring to return to an unstressed condition thereof. Preferably, first and second clutch plates are disposed on respective sides of the spring support collar.

In an alternate preferred embodiment, a media supply for a thermal ink printer, includes a central shaft defining a longitudinal axis, a media hub for supporting a spool of media and being coaxially rotatably mounted about the central shaft and having at least one radial rib extending axially along an outer surface of the media hub dimensioned to frictionally engage an interior surface of the spool of media, a torsion spring mounted about the central shaft and operatively engageable with the media hub to rotatably bias the media hub to an initial position corresponding to an unstressed condition of the torsion spring in response to movement of the media hub through first and second predetermined angular sectors of rotation in respective first and second rotational directions, to thereby maintain a predetermined level of tension on the media and clutch means associated with the media hub to permit the torsion spring to return to the unstressed condition in response to movement of the ribbon hub beyond either the first and second predetermined angular sectors of rotation.

Preferably, the media hub includes first and second diametrically opposed axial ribs. A hub clamp may also be mounted to the media hub and adapted for reciprocal axial movement therealong to accommodate media spools of various lengths. A locking member is associated with the hub clamp to selectively secure the hub clamp at a predetermined axial position.

BRIEF DESCRIPTION OF THE DRAWINGS

Preferred embodiments of the invention are described hereinbelow with reference to the drawing herein.

DETAILED DESCRIPTION OF THE PREFERRED EMBODIMENTS

Figure 1:
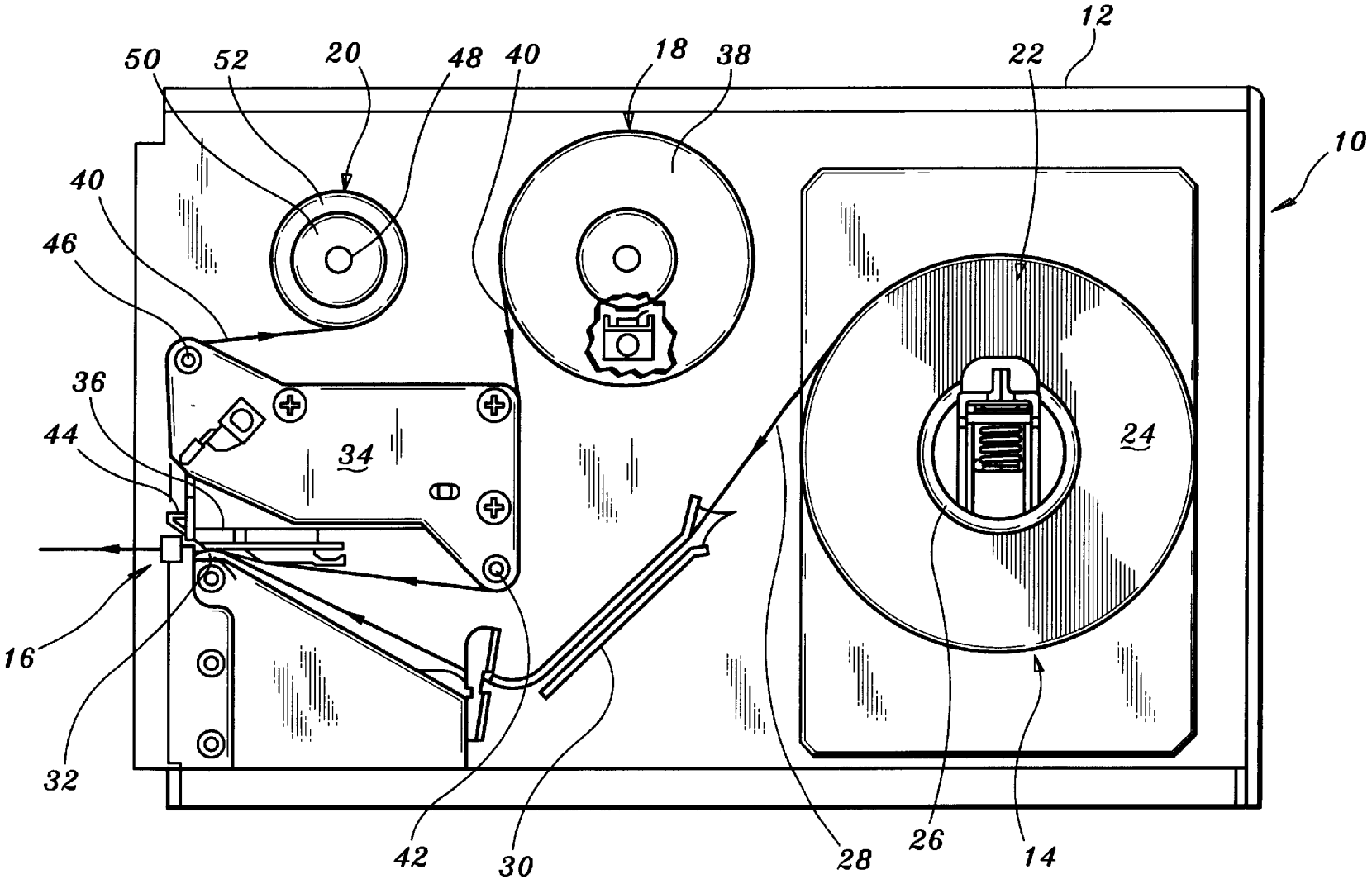
FIG. 1 is a schematic view of a printing section of a thermal label printer which may incorporate the media supply hub of the present invention.

Referring now in detail wherein like reference numerals identify similar or like reference numerals throughout the several views, FIG. 1 illustrates in schematic view, a representative printing section of a thermal printer which may utilize the ink ribbon supply of the present invention. This printing section is similar to the printing section disclosed in commonly assigned U.S. Pat. No. 5,326,182, the contents of which are incorporated herein by reference. Printing section 10 generally includes frame 12, media supply section 14, printing head section 16, ink ribbon supply section 18 and ink take-up section 20. Media supply section 14 includes media hub 22 which supports media supply roll 24. Media hub 22 will be discussed in greater detail hereinbelow in connection with the discussion of FIGS. 2–4. Media supply roll 24 includes core 26 of sleeve-like configuration and media web 28, consisting of blank labels provided on a coated paper substrate, wound into a roll about the core 26. Media web 28 is directed to printing head section 16 through guide 30 by rotation of pinch roller 32. The rotation of pinch roller 32 is under the direction of a motor of a control system (not shown). After the print is applied to the media web 28, the web is directed to a take-up location (not shown).

Printing head section 16 includes support structure 34 and thermal head section 36 mounted to the support structure 34. Thermal head section 36 applies ink to media web 28 to provide the desired print pattern. Ink ribbon supply section 18 includes ribbon supply assembly 38 and a supply of ink ribbon 40 would into a coiled configuration about a ribbon core. Ink ribbon 40 is directed about roller 42 mounted to support structure 34 and through printing thermal head section 36. Ink ribbon 40, after emerging from between pinch roller 32 and thermal head section 36, passes over plate 44 and roller 46, both of which are mounted in support structure 34, to ink take-up section 20.

Ink take-up section 20 includes drive shaft 48, drive support hub 50 and ink take-up roll 52 which accumulates the used ink ribbon 40 in a rolled configuration. Drive shaft 48 and drive support hub 50 are typically driven by an electric motor to advance the ink ribbon 40 from ink ribbon supply 38.

The above-described printing section 10 is representative of only one type of printing section of a thermal ink printer, which may incorporate the media supply section 14 22 of the present invention. It is to be appreciated that other printing arrangements may be adapted to utilize the media supply section 14.

Figure 2:
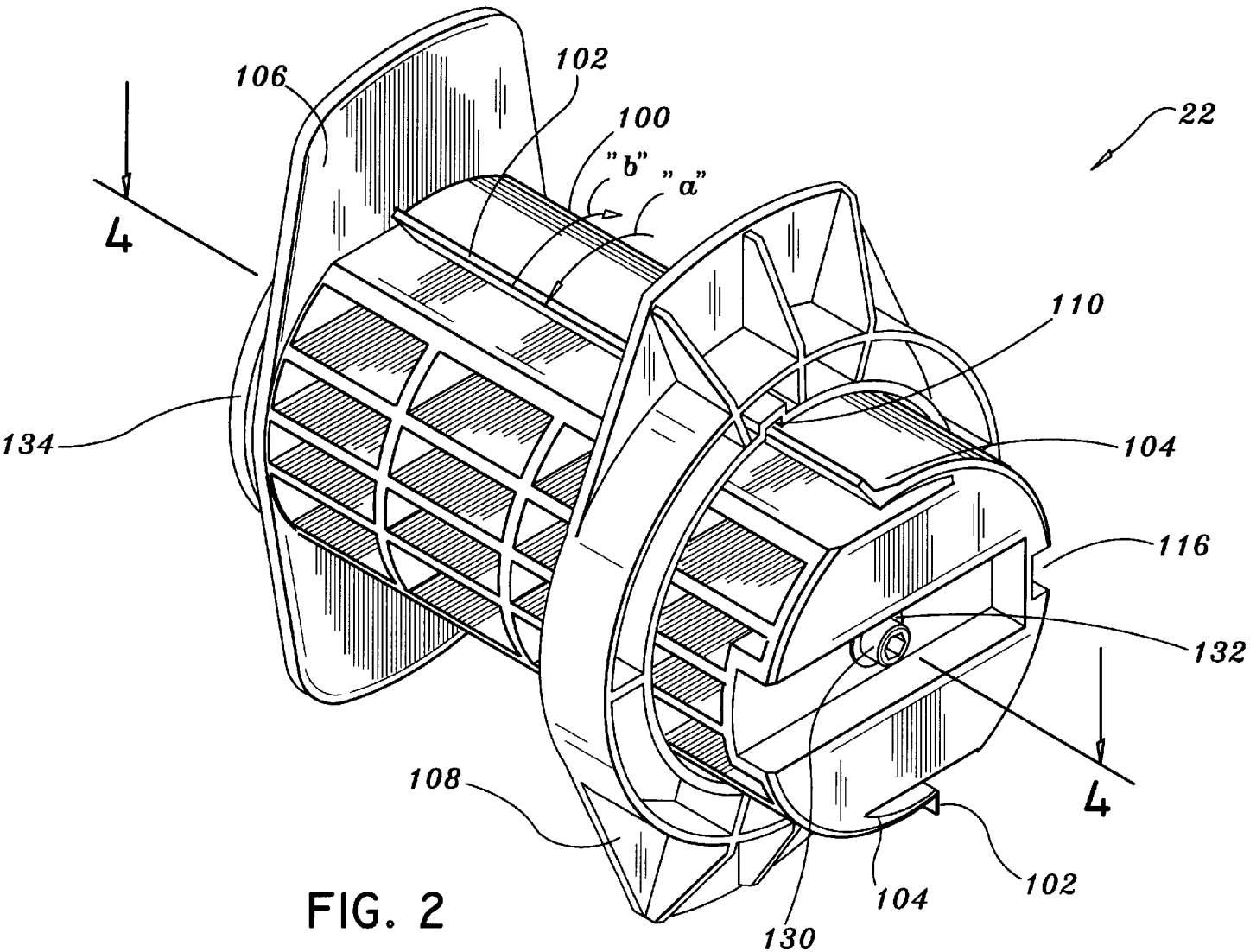
FIG. 2 is a perspective view of the media supply hub.
Figure 3:
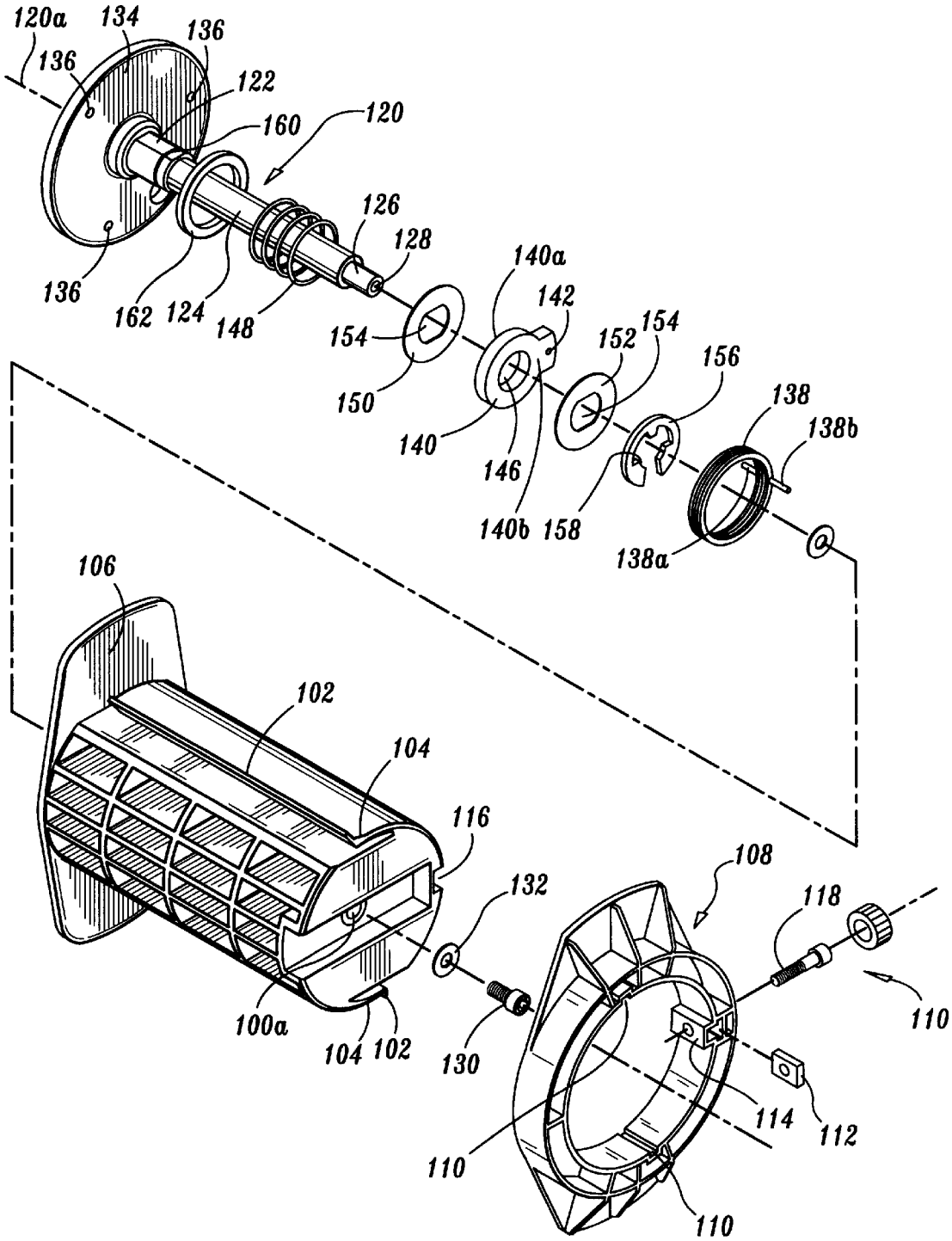
FIG. 3 is a perspective view with parts separated of the media supply hub further detailing the components thereof.
Figure 4:
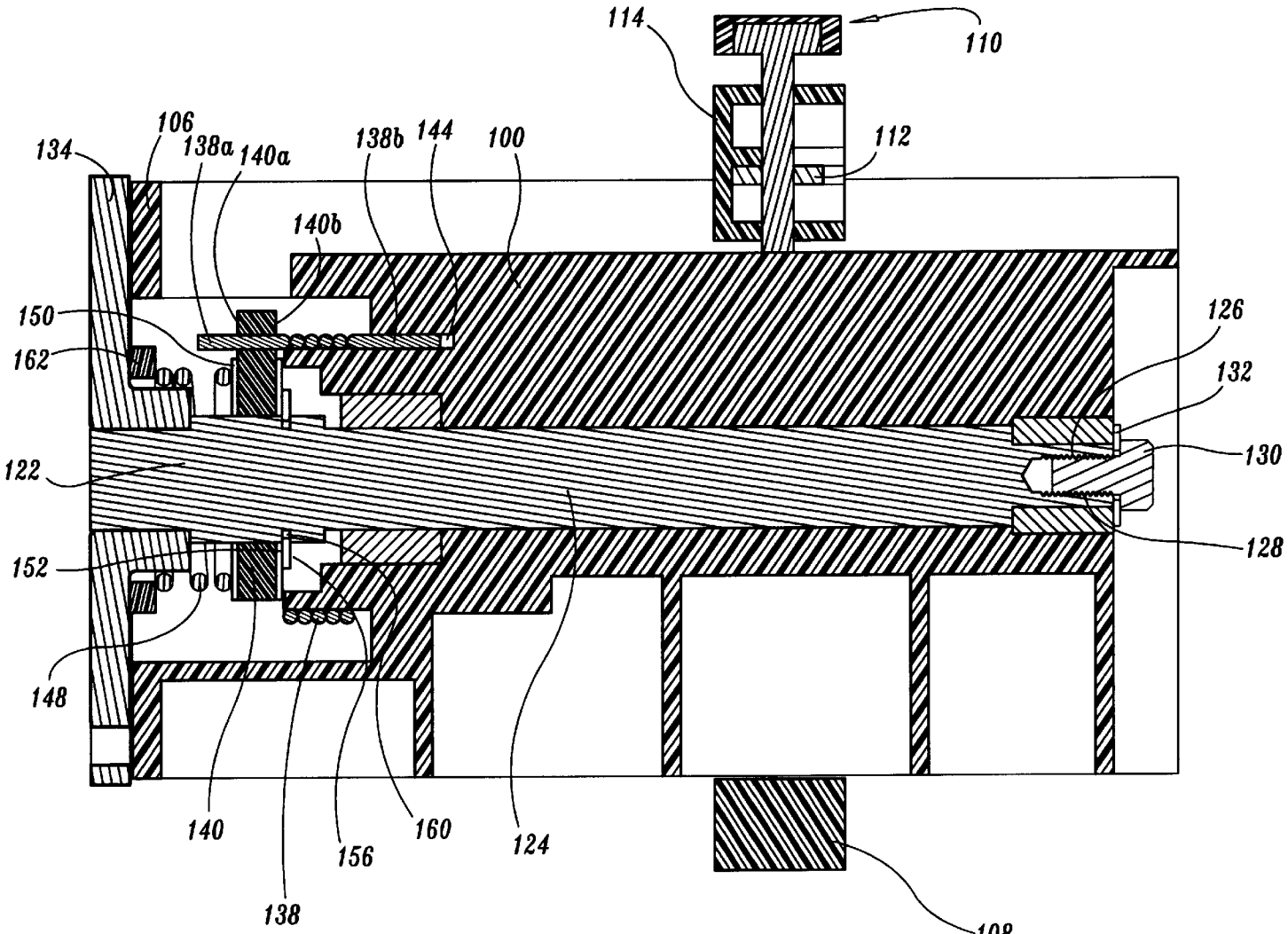
FIG. 4 is a cross-sectional view of the media supply hub taken along the lines 4—4 of FIG. 3.

Referring now to FIGS. 2–4, the media supply assembly 22 in accordance with the principles of the present disclosure will be discussed in detail. Media supply assembly 22 includes media supply support or hub 100 about which the media supply roll 24 is positioned. Media hub 100 may be fabricated from a suitable metal including stainless steel or aluminum. Preferably, media hub 100 is formed of a plastic material and manufactured using molding techniques.

Media hub 100 is generally circular in cross-section to correspond to the circular core 26 of media supply roll 24. Media hub 100 includes first and second diametrically opposed longitudinal ribs 102 extending along the entire length of media hub 100. Longitudinal ribs 102 project radially outwardly and are advantageously dimensioned to form a frictional engagement with the interior surface of the core or spool 26 of media supply roll 24 in a manner whereby rotational movement of the media supply roll 24 causes corresponding rotational movement of the media hub 100. Longitudinal ribs 102 are each disposed on cantilevered portions 104 which are normally outwardly biased to the position shown in the Figures, but, are capable of inward flexing movement. Accordingly, upon positioning of the media spool 26 on media hub 100, cantilevered portions 104 may flex inwardly through engagement of longitudinal ribs 102 with the interior of the media spool 26 whereby the outward bias of the cantilevered portions 104 ensures a desired frictional engagement of longitudinal ribs 102 with the interior of the media spool.

Media hub 100 has an end flange 106 integrally formed at one end thereof which functions as a stop for one end of the media spool 26 positioned on media hub 100. A locking hub clamp or flange 108 is slidably mounted on media hub 100 to engage the other end of the media spool 26. Hub clamp 108 is selectively movable on media hub 100 to accommodate various length media spools. In a preferred arrangement, hub clamp 108 includes first and second longitudinal recesses 110 formed in the interior surface thereof. Recesses 110 accommodate longitudinal ribs 102 of media hub 100 and are dimensioned to permit hub clamp 108 to slide along media hub 100 without interference of the longitudinal ribs 102.

Hub clamp 108 further includes locking fastener 111, and locking nut 112 securely mounted within a correspondingly dimensioned mount 114 formed in hub clamp 108. Mount 114 is slidably received within correspondingly dimensioned longitudinal rail 116 defined in media hub 100. Locking fastener 111 has a threaded portion 118 which extends through and threadably engages the internal threaded aperture of locking nut 112 thereby permitting translation of the locking fastener 111 through the locking nut 112 through manual rotation of the fastener 111. Locking fastener 111 is movable to engage media hub 100 and thereby selectively secure the hub clamp 110 at a desired axial position to secure the media spool 24 between flange 108 and the hub clamp 108.

Referring still to FIGS. 2–4, media supply assembly 22 further includes stationary central shaft 120 about which media hub 100 rotates. In particular, central shaft 120 is received within central axial bore 100*a* extending through media hub 100. Central shaft 120 defines longitudinal axis 120*a* and possessing proximal shaft section 122, main shaft section 124 and distal shaft section 126. Proximal shaft section 122 defines a non-circular or eccentric cross-section while main and distal shaft sections 124, 126 each define circular cross-sections with the diameter of the distal shaft section 126 being reduced as shown. Distal shaft section 126 further includes internal threaded bore 128. Threaded bore 128 receives threaded fastener 130 and washer 132 to mount the media hub 100 to the central shaft 120.

A circular mounting flange 134 is affixed to proximal shaft section 122 of central shaft 120. Mounting flange 134 is directly mountable to frame 12 and includes three spaced apertures 136 which receive corresponding mounting fasteners (not shown) of frame 10 to mount the mounting flange 134 and thus mounting hub 100 to the frame 12.

Media supply 22 further includes a torsion spring mechanism which maintains a predetermined level of drag or tension on the media web 28 during rotation of media hub 100 through a predetermined angular sector of rotation. Torsion spring mechanism includes torsion spring 138 and spring support collar each being mounted in coaxial arrangement about central shaft 120. Torsion spring 138 is anchored at one end to spring support collar 140 by reception of proximal longitudinal portion 138*a* of the torsion spring 138 within a correspondingly dimensioned aperture 142 formed in support collar 140. The other end (e.g., distal) of torsion spring 138 is anchored in media hub 100 by reception of distal longitudinal portion 138*b* within a corresponding longitudinal bore 144 in media hub 100. Torsion spring 138 is dimensioned to rotatably bias media hub 100 to an initial rest position upon movement of media hub 100 in either rotational direction about longitudinal axis 102*a*. In the preferred embodiment, torsion spring has a spring contact ranging from about 20 to 90

$$\frac{\text{oz}-\text{in}}{rev}.$$

Support collar 140 includes circular aperture 146 which is positioned about proximal shaft portion 122 of central shaft 120 in the assembled condition of the media supply. Aperture 146 defines a diameter greater than the cross-sectional dimension of eccentric proximal shaft section 122 such that spring support collar 146 is capable of rotating about the shaft section 122, the significance of which will be discussed in greater detail below.

A clutch mechanism including compression spring 148 and clutch plates 150, 152 are mounted about proximal shaft section 122 adjacent torsion spring 138 and spring support collar 140. Clutch plates 150, 152 are disposed on respective sides 140*a*, 140*b* of support collar 140 as shown. Clutch plates 150, 152 each define eccentric apertures 154 corresponding in dimension to the cross-sectional dimension of proximal shaft section 122. In this manner, clutch plates 150, 152 are rotatably fixed on central shaft, 102. A locking clasp 156 is mounted on proximal shaft section 104 adjacent clutch plate 152. Locking clasp 156 includes locking structure 158 adapted to be received within circumferential groove 160 formed in proximal shaft section 122 to secure the locking clasp 156 at a fixed axial position on central shaft 102.

Compression spring 148 is dimensioned to engage clutch plate 150 to normally bias the clutch plate 150 against spring support collar 136. Due to the fixed axial positioning of locking clasp 156, the biasing force of compression spring 148 establishes frictional relationships between the adjacent surfaces of clutch plate 150 and spring support collar 140 and the adjacent surfaces of clutch plate 152 and the support collar 140, thus establishing a slip clutch arrangement or mechanism. Generally, the slip clutch arrangement permits support collar 140 to move when the torque or torsional forces of torsion spring overcome the frictional relation between clutch plates 150, 152 and the support collar 140 thereby enabling the torsion spring 138 to return to an unstressed condition.

The clutch mechanism may further include a spacer 162 mounted about central shaft 102 interposed between mounting flange 134 and compression spring 148. Spacer 162 is intended to increase the degree of compressive forces exerted by compression spring 148 on clutch plate 150 to increase the torque level of the clutch. It is envisioned that spacer 162 may be removed to decrease the torque level. Similarly, a second spacer may be utilized as well to provide an increased torque level as well.

Further details of media supply of the present invention will be better appreciated by the following description of same in use to feed media web and labels to printing head section 16 with the printing section disclosed in FIG. 1. The media supply of the present invention may be utilized to feed media web 28 in either rotational direction of media hub 100. In particular, media hub 100 may rotate in the direction indicated by directional arrow "a" (FIG. 2) to feed the media to printing head section 16, or the media hub may rotate in the direction indicated by the directional arrow "b" to feed the media. The particular rotation or use of media hub will depend on the manner in which the media and labels are coiled on the supply spool.

In use of supply assembly 100 in the rotational direction "a" of media hub 100, the spool of media is positioned on the media hub 100 and the motor associated with pinch roller 32 is actuated to pull the media with labels off the media hub 100. As indicated above, media hub 100 is provided with longitudinal ribs 102 to frictionally engage the inner surface of the media spool 26 such that rotation of the spool 26 causes corresponding rotation of the media hub 100. Cantilevered portions 104 also assist in ensuring the desired frictional engagement as well. As media hub 100 rotates in the direction of directional arrow "a", spring support collar 140 remains stationary due to the frictional engagement of stationary clutch plates 150, 152 with the support collar 140. Such rotation causes torsion spring 138 to be tensioned, i.e., the rotation of media hub causes the distal end 138*b* of torsion spring 138 to rotate about the central axis 102*a* while the proximal spring end 138*a* remains stationary, thereby tensioning the torsion spring 138. As appreciated, the torsion spring 138 continually rotatably biases media hub 100 in the direction of arrow "b" corresponding to an unstressed condition of the torsion spring 138, thus maintaining a sufficient level of tension on the media during feeding and the printing step.

Media hub 100 is continually rotated in direction "a" to feed the media labels. Once the torsional force or torque of torsion spring 138 overcomes the frictional forces between the adjacent surfaces (as provided by compression spring 148) of clutch plates 150,152 and spring support collar 140, the clutch releases thereby permitting the support collar 140 to slip or move relative to the clutch plates 150,152 under the influence of torsion spring 138 to cause the support collar 140 to move (e.g., rotate in direction "b") relative to central shaft 102 to an initial position which corresponds to an unstressed condition of torsion spring 138. At this point, torsion spring 138 is reset and media hub 100 may be rotated in a similar manner (in direction "a") to feed media web 28 to printing head section 16.

Media hub 100 may also operate to feed media web 28 by rotating in the feed direction of directional arrow "b". During movement of media hub 100 in this direction, torsion spring 138 is caused to move in a direction corresponding to a stressed condition to cause the spring 138 to "unwind". The torsional characteristics of torsion spring 138 (i.e., the tendency of torsion spring 138 to return to its initial unstressed condition) continuously biases media hub 100 in direction "a" thereby maintaining a level of tension on the media web 28 during feeding and printing. Media hub 100 is rotated in direction "b" through a predetermined angular sector of rotation. When the torsional force of torsion spring 138 overcomes the forces (friction) between the adjacent surfaces of clutch plates 150, 152 and support collar 140, the slip clutch releases thereby permitting support collar 140 to rotate about proximal shaft section 122 in direction "a" to permit torsion spring 138 to assume its initial at-rest position. Thus, torsion spring 138 is reset to permit continued feeding media web 28 in direction "b".

Thus, the media supply assembly of the present invention maintains a sufficient level of tension on the media web 28 regardless of the rotational direction of media hub 100. Torsion spring 138 maintains a level of tension on the media web 28 during printing thereby improving print registration and quality. In addition, the uniform tension maintained on media web 28 via torsion spring 138 and clutch plates 150, 155 reduces dynamic loads caused by the acceleration of the media as the system (feed motor) accelerates. Another advantageous feature of torsion spring 138 is that it provides a predictable rotatable response of media hub 100 during starting and stopping. In particular, torsion spring 138 has a quantifiable or given angular natural frequency. Based on this natural frequency, the acceleration rates at which the printer operates (e.g. speed of the motor) may be pre-programmed or controlled to reduce the effect of the spring's angular frequency thereby minimizing undesired speed changes of the media web 28 during start-up and stopping. Thus, an internal self-contained control of undesirable acceleration loads is provided. This obviates the need as in conventional thermal printers for a separate spring loaded damper or buffer positioned between the media supply support and the printing head.

While the above description contains many specifics, these specifics should not be construed as limitations on the scope of the disclosure, but merely as exemplifications of preferred embodiments thereof. For example, it is envisioned that other types of slip clutch arrangements are envisioned as well including powered or driven shafts through the same arrangement. Those skilled in the art will envision many other possible variations that are within the scope and spirit of the disclosure as defined by the claims appended hereto.

What is claimed is:

1. A media supply apparatus for a thermal ink printer, which comprises:

a central shaft defining a longitudinal axis;

a media hub coaxially mounted about said central shaft and being rotatably movable relative to said central shaft, said media hub defining a peripheral outer surface for supporting a supply of media in a coiled configuration;

a hub clamp mounted to said peripheral outer surface of said media hub and axially movable along said peripheral outer surface of said media hub to accommodate media supplies of various sizes; and a torsion spring mounted about said central shaft and operatively engageable with said media hub to rotatably bias said media hub to an initial position corresponding to an unstressed condition of said torsion spring in response to movement of said media hub through a predetermined angular sector of rotation in one rotational direction, to thereby maintain a predetermined level of tension on the media of the supply of media.

2. The media supply apparatus according to claim 1 including a locking member associated with said hub clamp to selectively secure said hub clamp at a predetermined axial position.

3. The media supply apparatus according to claim 1 wherein said torsion spring is adapted to rotatably bias said media hub to said initial position upon movement of said media hub through a second predetermined angular sector of rotation in a second rotational direction.

4. The media supply apparatus according to claim 1 including at least one longitudinal rib extending radially from said peripheral outer surface of said media hub, said at least one longitudinal rib dimensioned to engage an interior surface of the supply of media in frictional engagement therewith.

5. The media supply apparatus according to claim 4 including first and second diametrically opposed longitudinal ribs.

6. The media supply apparatus according to claim 1 including a clutch associated with said media hub to permit said torsion spring to return to said unstressed condition in response to movement of said media hub beyond said predetermined angular sector of rotation.

7. The media supply apparatus according to claim 6 including a spring support collar operatively connected to one end portion of said torsion spring wherein the other end portion of the torsion spring is operatively connected to said media hub.

8. The media supply apparatus according to claim 7 wherein said clutch comprises a compression spring and a clutch plate, said compression spring in operative engagement with said clutch plate and dimensioned to bias said clutch plate toward said spring support collar.

9. The media supply apparatus according to claim 8 wherein said clutch plate is in contacting frictional engagement with said spring support collar, wherein movement of said media hub beyond said predetermined angular sector of rotation causes release of said clutch plate from the frictional engagement with said spring support collar to permit said spring support collar to move relative to said clutch plate to thereby enable said tension spring to return to an unstressed condition thereof.

10. The media supply apparatus according to claim 9 including first and second clutch plates disposed on respective sides of said spring support collar.

11. The media supply apparatus according to claim 8 wherein said clutch includes a spacer member mounted about said central shaft adjacent one end of said compression spring, said spacer member dimensioned to increase biasing forces of said clutch plate on said spring retention member.

12. The media supply apparatus according to claim 11 wherein said spacer member is removable.

13. A media supply apparatus for a thermal ink printer, which comprises:

a central shaft defining a longitudinal axis;

a media hub coaxially mounted about said central shaft and rotatable movable relative to said central shaft, said media hub for supporting a supply of media in a coiled configuration, said media hub including at least one longitudinal rib extending radially from an outer surface of said media hub, said at least one longitudinal rib dimensioned to engage the interior surface of the supply of media in frictional engagement therewith;

a hub clamp mounted to said media hub, said hub clamp being axially movable along said media hub to accommodate supplies of media of various sizes, said hub clamp including an inner longitudinal recess dimensioned to accommodate said at least one longitudinal rib of said media hub; and a torsion spring mounted about said central shaft and operatively engageable with said media hub to rotatably bias said media hub to an initial position corresponding to an unstressed condition of said torsion spring in response to movement of said media hub through a predetermined angular sector of rotation in one rotational direction, to thereby maintain a predetermined level of tension on the media of the supply of media.

14. A media supply spool assembly for a thermal ink printer, which comprises:

a central shaft defining a longitudinal axis;

a media hub coaxially mounted about said central shaft and rotatably movable relative to said central shaft, said media hub for supporting a spool of media, said media hub including at least one axial rib extending axially along an outer surface of said media hub, said at least one rib dimensioned to frictionally engage an interior surface of the spool of media;

a torsion spring mounted about said central shaft and operatively connected to said media hub to rotatably bias said media hub to an initial position corresponding to an unstressed condition of said torsion spring in response to movement of said media hub through first and second predetermined angular sectors of rotation in respective first and second rotational directions, to thereby maintain a predetermined level of tension on the media; and a clutch associated with said media hub to permit said torsion spring to return to said unstressed condition in response to movement of said media hub beyond either said first and second predetermined angular sectors of rotation, said clutch including at least one clutch plate.

15. The media supply assembly according to claim 14 including first and second diametrically opposed axial ribs.

16. The media supply apparatus according to claim 15 including a hub clamp mounted to said media hub, said hub clamp being axially movable along said media hub to accommodate spools of media of various lengths.

17. The media supply apparatus according to claim 16 including a locking member associated with said hub clamp to selectively secure said hub clamp at a predetermined axial position.

18. A media supply apparatus for a thermal ink printer, which comprises:

a central shaft defining a longitudinal axis:

a media hub coaxially mounted about said central shaft and rotatably movable about said longitudinal axis, said media hub for supporting a supply of media in a coiled configuration;

a coil spring mounted about said central shaft and operatively engageable with said media hub to rotatably bias said media hub to an initial position corresponding to an unstressed condition of said coil spring in response to movement of said media hub through first and second predetermined angular sectors of rotation in respective first and second rotational directions, to thereby maintain a predetermined level of tension on the media of supply of media; and a hub clamp positioned about said media hub and reciprocally axially movable relative to said media hub to accommodate supplies of media of various sizes.

19. The media supply apparatus according to claim 18 further including a clutch member associated with said media hub, said clutch member dimensioned and configured to permit said coil spring to return to said unstressed condition in response to movement of said media hub beyond either said first and second predetermined angular sectors of rotation.

20. A media supply apparatus for a thermal ink printer, which comprises:

a central shaft defining a longitudinal axis;

a media hub coaxially mounted about said central shaft and being rotatably movable relative to said central shaft, said media hub defining a peripheral outer surface for supporting a supply of media in a coiled configuration; and a hub clamp mounted to said peripheral outer surface of said media hub and axially movable along said peripheral outer surface of said media hub to accommodate media supplies of various sizes.

21. The media supply apparatus of claim 20 wherein said media hub is biased to an initial position in response to movement of said media hub through a predetermined angular sector of rotation, thereby maintaining a predetermined level of tension on the media of the supply of media.

22. A media supply apparatus for a thermal ink printer, which comprises:

a central shaft defining a longitudinal axis;

a media hub coaxially mounted about said central shaft and being rotatably movable relative to said central shaft, said media hub for supporting a supply of media in a coiled configuration;

a hub clamp mounted to said media hub and axially movable along said media hub to accommodate supplies of media of various sizes; and a locking member mounted to said hub clamp and movable relative to said hub clamp to selectively secure said hub clamp at a predetermined axial position.

23. The media supply apparatus of claim 22 wherein said locking member is accommodated within an opening defined in said hub clamp, said locking member being movable to engage said media hub to secure said hub clamp.

24. The media supply apparatus of claim 22 wherein said media hub defines a peripheral outer surface which supports the supply of media, said hub clamp being axially movable along said peripheral outer surface.

* * * * *